US007467728B2

(12) United States Patent
Lundy et al.

(10) Patent No.: US 7,467,728 B2
(45) Date of Patent: Dec. 23, 2008

(54) BUCKET

(75) Inventors: Michael J. Lundy, Mesa, AZ (US); Ronald D. Pike, Phoenix, AZ (US); Raymond S. Zuckerman, Scottsdale, AZ (US)

(73) Assignee: Wonder Line Salses, L.L.C., Mesa, AZ (US)

( * ) Notice: Subject to any disclaimer, the term of this patent is extended or adjusted under 35 U.S.C. 154(b) by 308 days.

(21) Appl. No.: 11/445,097

(22) Filed: Jun. 1, 2006

(65) Prior Publication Data

US 2006/0219720 A1 Oct. 5, 2006

Related U.S. Application Data

(63) Continuation-in-part of application No. 10/965,583, filed on Oct. 14, 2004.

(51) Int. Cl.
*B65D 25/24* (2006.01)
*B65D 90/12* (2006.01)

(52) U.S. Cl. ..... 220/629; 220/505

(58) Field of Classification Search ..... 220/505, 220/553, 555, 628, 629, 697, 729, 735, 736
See application file for complete search history.

(56) References Cited

U.S. PATENT DOCUMENTS 2,896,809 A * 7/1959 Metzger et al. ..... 220/553
5,390,812 A * 2/1995 Spiro ..... 220/495.06
5,810,196 A 9/1998 Lundy
6,062,389 A * 5/2000 Kent ..... 206/518
6,065,633 A * 5/2000 Abbey ..... 220/501
6,105,813 A * 8/2000 Abbey ..... 220/570
6,138,963 A * 10/2000 Malvasio ..... 248/111

* cited by examiner

*Primary Examiner*—Anthony D Stashick
*Assistant Examiner*—Harry A Grosso
(74) *Attorney, Agent, or Firm*—Parson & Goltry; Robert A. Parsons; Michael W. Goltry

(57) ABSTRACT

A bucket includes a first volume defined by a continuous primary sidewall extending from a periphery of a first bottom to a primary rim and has a flattened portion extending from the periphery of the first bottom to a subjacent portion of the primary rim. An inner surface of the flattened portion of the primary sidewall is textured to form a paint roller grid. A second volume is defined by a continuous secondary sidewall extending from a periphery of a second bottom to a secondary rim and has a flattened portion extending from the periphery of the second bottom to a subjacent portion of the secondary rim adjacent the subjacent portion of the primary rim. An edge couples the subjacent portion of the secondary rim and the subjacent portion of the primary rim.

12 Claims, 7 Drawing Sheets

BUCKET

CROSS-REFERENCE TO RELATED APPLICATION

This application is a continuation-in-part application of co-pending U.S. application Ser. No. 10/965,583, filed Oct. 14, 2004, entitled BUCKET.

FIELD OF THE INVENTION

This invention relates to vessels.

More particularly, the present invention relates to buckets and painting accessories.

BACKGROUND OF THE INVENTION

Containers for carrying fluids have long been known in particular, buckets have been known for centuries. Fluids such as paint or cleaning fluids are often carried and applied from containers to such as buckets. Often, additional implements such as paint rollers, brushes and other tools are required during a painting project or other project requiring the use of a container. Keeping track of fluid supplies, such as paint, and other implements can be inconvenient. When a certain implement is required, it may have been left behind or stored in another location. Other problems specifically noticed during the painting process, is that during the use of either the roller or the brush, the user is presented with the problem of where to store the implement not being used.

Additionally, in the world today, shipping of large quantities of items is almost essential for successful distribution. Therefore, the ability to collect a plurality of items into a small space is highly desirable. Thus, stacking height becomes an important consideration. Specialty containers typically cannot be stacked to reduce the space used due to specialty interior structures.

It would be highly advantageous, therefore, to remedy the foregoing and other deficiencies inherent in the prior art.

SUMMARY OF THE INVENTION

Briefly, to achieve the desired objects and advantages of the instant invention in accordance with a preferred embodiment thereof, provided is a bucket which includes a first volume defined by a continuous primary sidewall extending from a periphery of a first bottom to a primary rim and has a flattened portion extending from the periphery of the first bottom to a subjacent portion of the primary rim. A second volume is defined by a continuous secondary sidewall extending from a periphery of a second bottom to a secondary rim and has a flattened portion extending from the periphery of the second bottom to a subjacent portion of the secondary rim adjacent the subjacent portion of the primary rim. An edge couples the subjacent portion of the secondary rim and the subjacent portion of the primary rim.

In another aspect of the invention, an inner surface of the flattened portion of the primary sidewall is textured to form a paint roller grid. Additionally, at least one divider base can be provided, extending from second bottom. The at least one divider base extends toward secondary rim a distance less than a stacking height of the bucket. Divider panels removably engage the at least one divider base, dividing the second volume into a plurality of compartments.

In yet another aspect, a collar extends from the continuous periphery adjacent the primary sidewall and the secondary sidewall a distance defining a stacking height of the bucket.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 4:
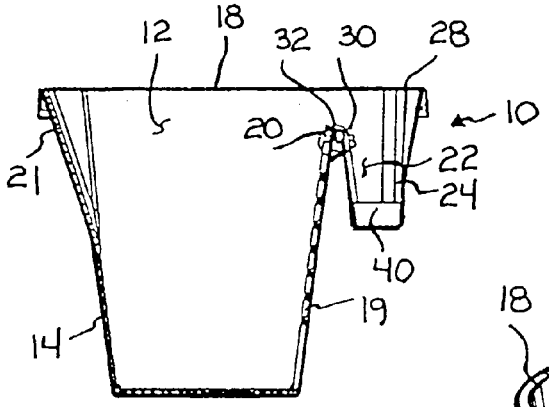
FIG. 4 is a sectional side view of the bucket of FIG. 3.

Turning now to the drawings in which like reference characters indicate corresponding elements throughout the several views, attention is first directed to FIGS. 1, 2, 3, and 4, which illustrate a bucket generally designated 10. While bucket 10 is intended to be employed in various operations such as application of fluids such as paint, varnish, polyurethane, etc., it will be understood by those skilled in the art that bucket 10 may also be used as a general use bucket in cleaning operations, maintenance, and the like. Bucket 10 may be fabricated in many manners, but a preferred method includes molding from plastic materials. While plastic materials are preferred, it will be understood that bucket 10 can be constructed of other materials such as metals, ceramics, etc.

Bucket 10 includes a first volume 12 defined by a continuous primary sidewall 14 extending from a periphery 15 of a first bottom 16 to a primary rim 18. Continuous primary sidewall 14 includes, as a portion thereof, a flattened portion 19 extending from periphery 15 of first bottom 16 to a subjacent portion 20 of primary rim 18. Subjacent portion 20 is subjacent to (recessed below) the remainder of primary rim 18. Continuous primary sidewall 14 can also include a pour spout 21 formed in primary rim 18 opposing subjacent portion 20, if desired. As will be explained in detail subsequently, spout 21 can facilitate separation of buckets can when stacked for storage or shipping.

Bucket 10 further includes a second volume 22 defined by a continuous secondary sidewall 24 extending from a periphery 25 of a second bottom 26 to a secondary rim 28. Continuous secondary sidewall 24 includes, as a portion thereof, a flattened portion 29 extending from periphery 25 of second bottom 26 to a subjacent portion 30 of secondary rim 28 adjacent subjacent portion 20 of primary rim 18. Subjacent portion 30 is subjacent to (recessed below) the remainder of primary rim 28. An edge 32 couples subjacent portion 30 of secondary rim 28 and subjacent portion 20 of primary rim 18. While first volume 12 and a second volume 22 may vary depending upon the desired uses, second volume 22 will typically be substantially less than first volume 12 as can be clearly seen in the figures.

Figure 1:
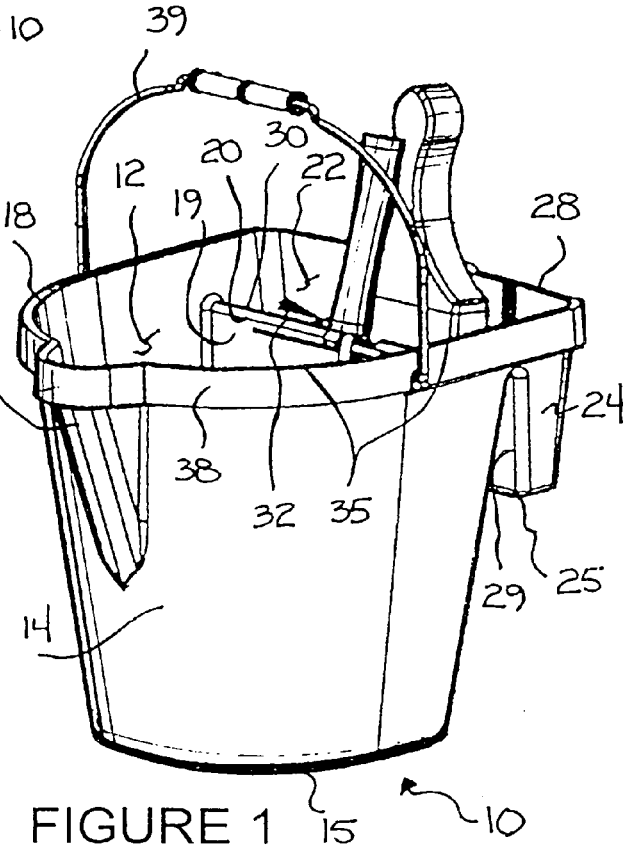
FIG. 1 is a perspective view of a bucket according to the present invention.
Figure 2:
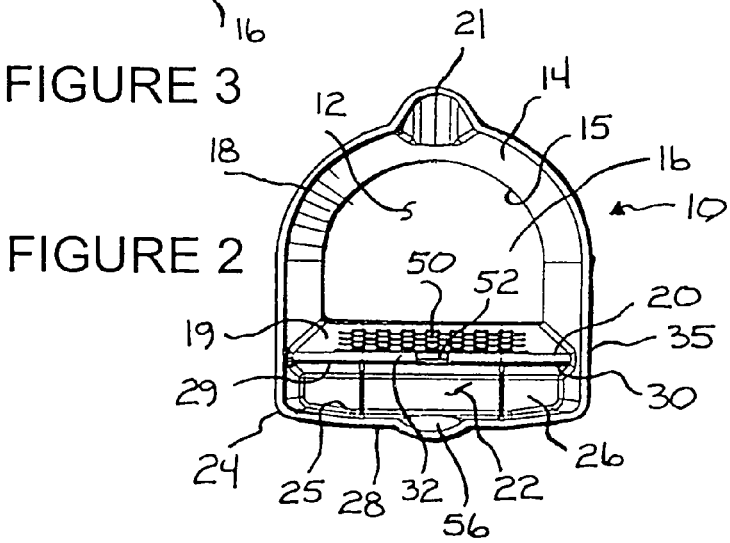
FIG. 2 is a top plan view of the bucket of FIG. 1.

Referring specifically to FIGS. 1 and 2, primary rim 18 and secondary rim 28 form a continuous periphery 35 about subjacent portion 30 of secondary rim 28 and subjacent portion 20 of primary rim 18. Thus, continuous periphery 35 entirely encircles bucket 10, at a level spaced from subjacent portions 20 and 30. In other words, primary rim 18 and secondary rim 28, absent subjacent portions 20 and 30 of each, respectively, form continuous periphery 35 about primary volume 12 and secondary volume 22. Primary volume 12 and secondary volume 22 are separated within continuous periphery 35 by flattened portion 19 and flattened portion 29 and their respective subjacent portions 20 and 30. Flattened portion 19 and flattened portion 29 diverge from edge 32 further separating primary volume 12 and secondary volume 22. First bottom 16 is spaced from second bottom 26 in a substantially parallel relationship. Since primary volume 12 and secondary volume 22 are different sizes, first bottom 16 and second bottom 26 are generally not coplanar, with second bottom 22 positioned closer to continuous periphery 35. Flattened portion 19 of primary sidewall 14 diverges from flattened portion 29 of secondary sidewall 24, from edge 32 to first bottom 16 and second bottom 26, respectively.

Figure 3:
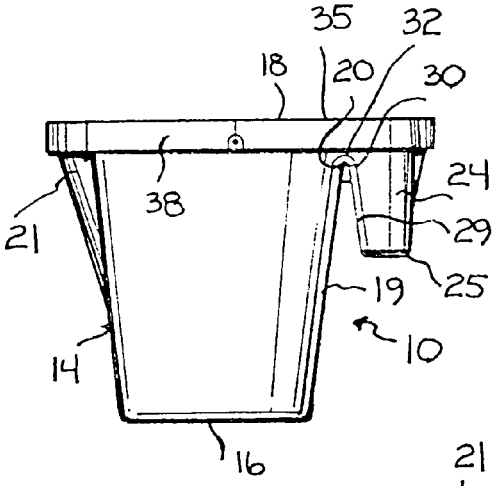
FIG. 3 is a side plan view of the bucket of FIG. 1.

Referring specifically to FIGS. 1 and 3, a collar 38 extends from continuous periphery 35 adjacent primary sidewall 14 and secondary sidewall 24 toward first bottom 16 and second bottom 26. Collar 38 provides rigidity and strength to bucket 10. Flattened portions 19 and 29 coupled at edge 32 also provide rigidity and structural support to bucket 10. A handle 39 can be provided, and coupled to continuous periphery 35 at collar 38. Handle 39 can be formed of greater size then is typically found in bucket structures. The greater size allows handle 39 to move from an upright position as shown in FIG. 1 to a lower position over the front of bucket 10 as can be seen with reference to FIGS. 8 and 10. Positioning handle 39 in a lowered position facilitates stacking of multiple buckets 10.

Figure 7:
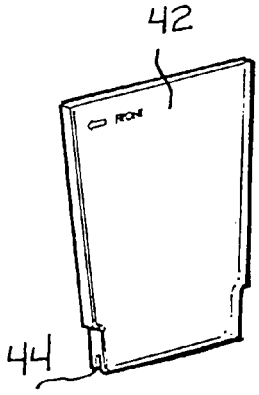
FIG. 7 is an enlarged perspective view of a divider panel according to the present invention.

Referring specifically to FIG. 4, at least one divider base 40, and preferably two divider bases extend from second bottom 26. Divider base 40 extends only a short distance upward from second bottom 26 for reasons of stackability as will be discussed presently. With additional reference to FIG. 6, a divider panel 42 removably engages each divider base 40, dividing second volume 22 into a plurality of compartments. Divider panel 42 is inserted between secondary sidewall 24 and flattened portion 29 to engage divider base 40. As can be seen with reference to FIG. 7, each divider panel 42 has a groove 44 formed in a lower edge thereof. A top edge of divider base 40 is received in groove 44, securely affixing divider panel 42 to divider base 40. Additional security and rigidity can be provided by molding grooves 46 in secondary sidewall 24 and opposing flattened portion 29.

Figure 5:
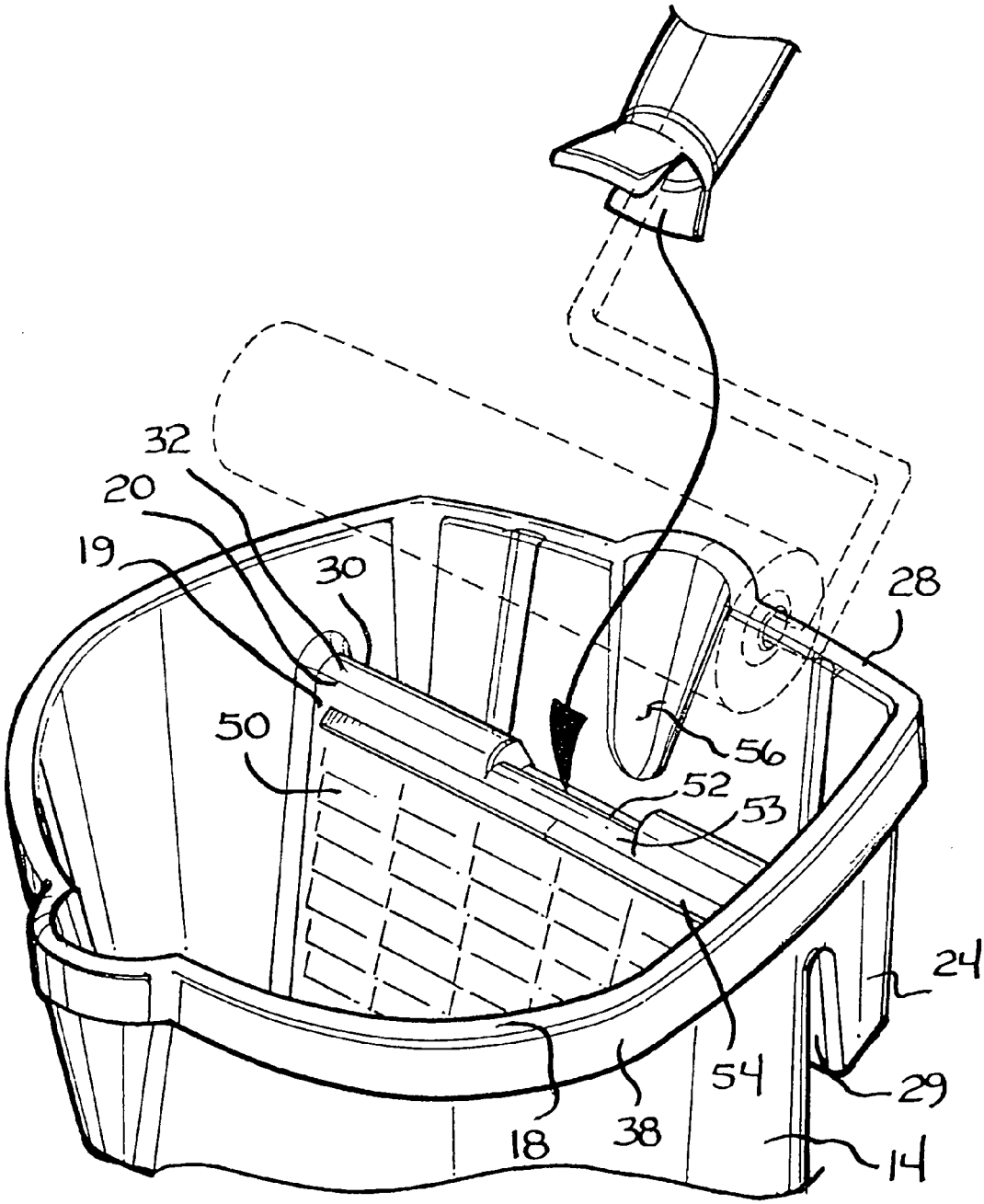
FIG. 5 is a partial perspective view of the bucket of FIG. 1.
Figure 6:
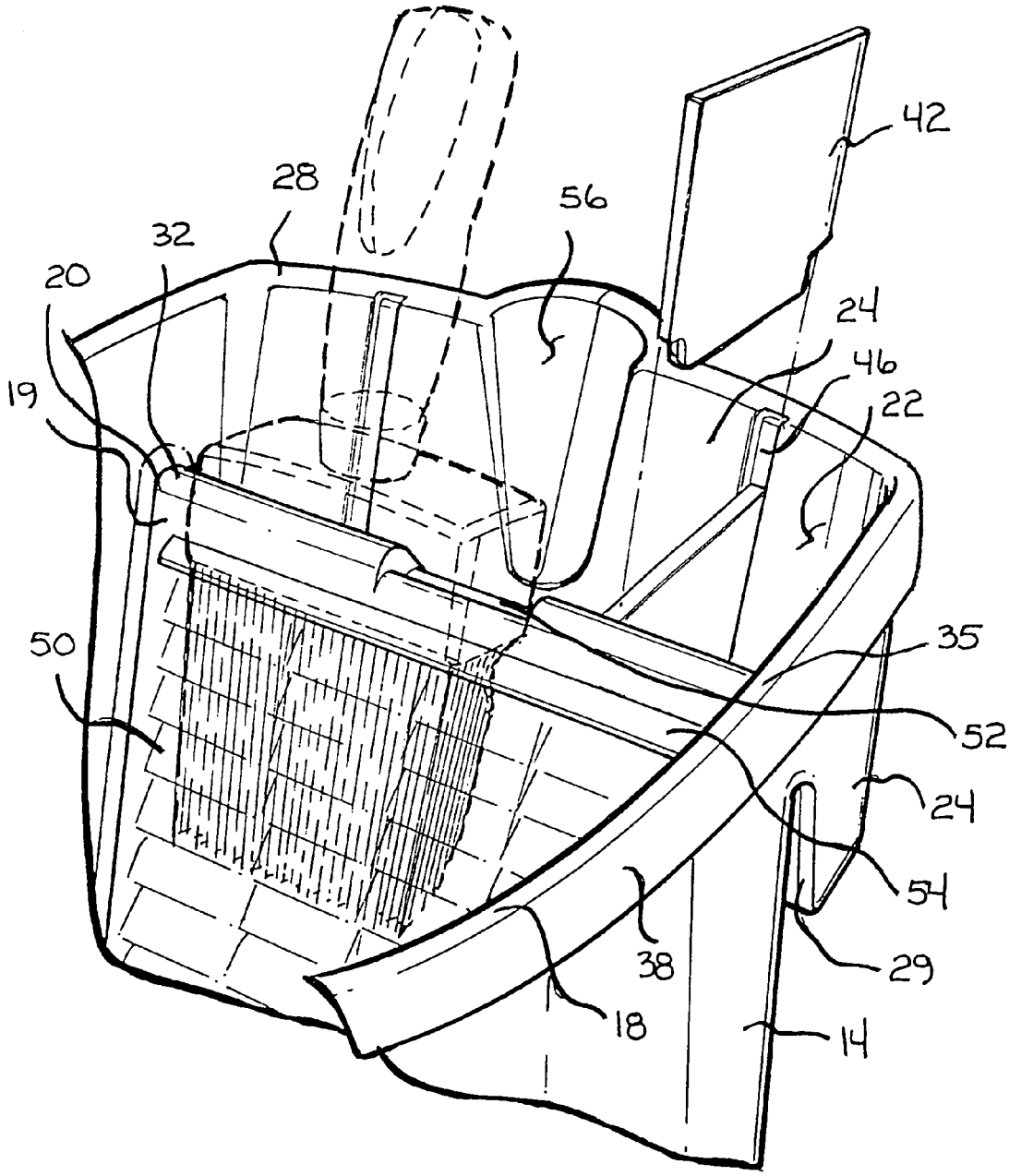
FIG. 6 is a partial perspective view of the bucket of FIG. 1 illustrating insertion of divider panels.

In a preferred embodiment, as can be seen if FIGS. 2, 5 and 6, an inner surface of flattened portion 19 of primary sidewall 14 is textured to form a paint roller grid 50. Paint roller grid 50 is used in a manner similar to conventional roller grates which are used to remove excess paint from roller brushes. Typically, roller grates are slanted for use. Paint roller grid 50 is slanted for this use by the shape of flattened portion 19 diverging from edge 32. The texturing of paint roller grid 50 can be formed during the molding of bucket 10. Alternatively, if materials other than plastic are employed, texturing techniques consistent with those materials will be employed.

Referring now to FIGS. 5 and 6, additional accessories can be provided on bucket 10. Specifically, edge 32 can be formed with a notch 52 formed therein centrally positioned intermediate opposing ends. Notch 52 can be seen in greater detail in FIG. 8. The divergence of flattened portions 19 and 29 result in a relatively thick edge 32. To enable a handle of a paint roller to engage and hang from edge 32, a notch 52 is formed providing a narrow portion 53 which the handle of the paint roller engages. Another feature is a scraping rib 54 extending from the inner surface of flattened portion 19 of primary sidewall 14 parallel to and proximate subjacent portion 20. Scraping rib 54 enables excess paint to be removed from a paint brush as desired. Yet another feature is an indentation 56 formed in secondary rim 28 opposing subjacent portion 30 and extending downwardly into secondary sidewall 24. Indentation 56 permits objects such as a paint brush to rest in secondary volume 22 in an upright position. A brush, for example, is maintained in an upright position by positioning of the handle thereof in indentation 56.

Figure 8:
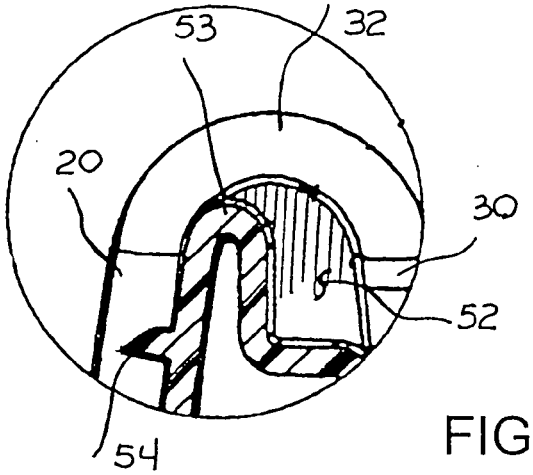
FIG. 8 is an enlarged to sectional view of the paint roller notch.
Figure 9:
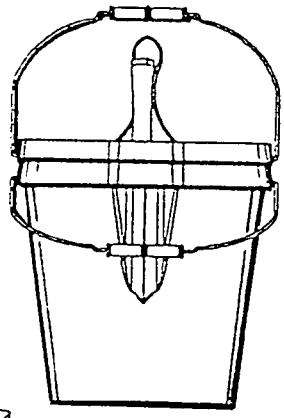
FIG. 9 is a front plan of a pair of stacked bucket according to the present invention.
Figure 10:
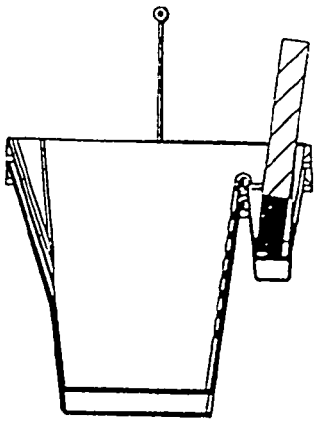
FIG. 10 is a sectional side view of the stacked buckets of FIG. 9.
Figure 11:
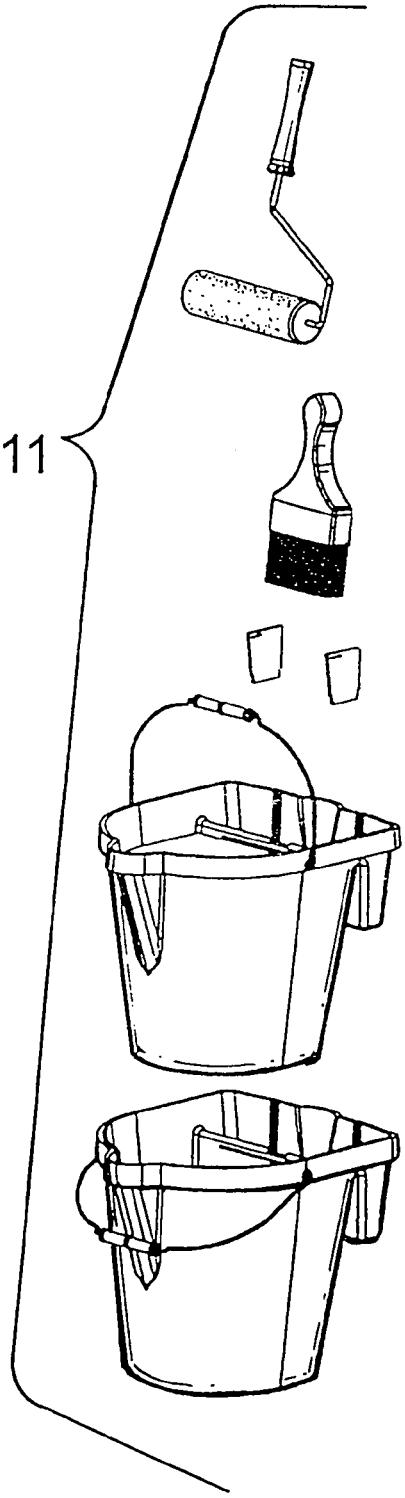
FIG. 11 is an exploded perspective view of the stacked buckets of FIG. 9.

Referring now to FIGS. 8, 9, and 10, bucket 10 is intended to have a very low stacking height, allowing a plurality of buckets 10 to be stacked for storage or shipping. When stacked, primary sidewall 14 and secondary sidewall 24 nest within primary volume 12 and secondary volume 22, respectively. This is possible due to the removability of divider panel 42 and the fact that divider base 40 does not rise a distance greater than the stacking height. The stacking height of buckets 10 is essentially controlled by the width of collar 38. As can be seen in FIG. 9, a bottom edge of collar 38 rests upon continuous periphery 35 of the underlying bucket. Thus, in a preferred embodiment, the stacking height of bucket 10 is defined by the width (height) of collar 38. Those skilled in the art will understand that the stacking height of bucket 10 may be greater than the width of collar 38 if desired, and may be increased by increasing the height of divider base 40. Additionally, it can be seen that edge 32 joining subjacent portions 20 and 30 is recessed below the level of continuous periphery 35 a distance equal to or greater than the stacking height of bucket 10. When stacked, suction created by the close nesting of buckets 10 is eliminated by various elements including pour spout 21, allowing separation of buckets 10.

Turning to FIGS. 12-15, a bucket generally designated 110 is illustrated. Bucket 110 is substantially identical to bucket 10 with the exception of including a base extension as will be described presently. Bucket 110 includes a first volume 112 defined by a continuous primary sidewall 114 extending from a periphery 115 of a first bottom 116 to a primary rim 118. Continuous primary sidewall 114 includes, as a portion thereof, a flattened portion 119 extending from periphery 15 of first bottom 116 to a subjacent portion 120 of primary rim 118. Subjacent portion 120 is subjacent to (recessed below) the remainder of primary rim 118. Continuous primary sidewall 114 can also include a pour spout 121 formed in primary rim 118 opposing subjacent portion 120, if desired.

Bucket 110 further includes a second volume 122 defined by a continuous secondary sidewall 124 extending from a periphery 125 of a second bottom 126 to a secondary rim 128. Continuous secondary sidewall 124 includes, as a portion thereof, a flattened portion 129 extending from periphery 125 of second bottom 126 to a subjacent portion 130 of secondary rim 128 adjacent subjacent portion 120 of primary rim 118. Subjacent portion 130 is subjacent to (recessed below) the remainder of primary rim 128. An edge 132 couples subjacent portion 130 of secondary rim 128 and subjacent portion 120 of primary rim 118. While first volume 112 and a second volume 122 may vary depending upon the desired uses, second volume 122 will typically be substantially less than first volume 112 as can be clearly seen in the figures.

Flattened portion 119 can include an inner surface textured to form a paint roller grid 150. Paint roller grid 150 is used in a manner similar to conventional roller grates which are used to remove excess paint from roller brushes. In conventional use, pressure may be applied to flattened portion 119 which can destabilize or tip bucket 110. To prevent inadvertent tipping or spilling of bucket 110, a base extension 160 is carried thereby. Base extension 160 includes a pair of parallel spaced apart rails 162 extending parallel to an outer surface of first bottom 116. Rails 162 extend from periphery 115 at flattened portion 119 to proximate periphery 115 opposite flattened portion 119. Rails 162 can be fastened to bottom 116 by adhesives, heat weld and the like, or as preferred, molded integrally with bucket 110. Rails 162 each define an inwardly directed channel 163 extending the length thereof. A footing 164 extends perpendicularly from bottom 116 around periphery 115 thereof. Footing 164 raises bucket 110 at least to the height (depth) of rails 162, providing a stable and level base and providing room for base extension 160. A gap 165 is formed in footing 164 at periphery 115 adjacent flattened portion 119.

Figure 12:
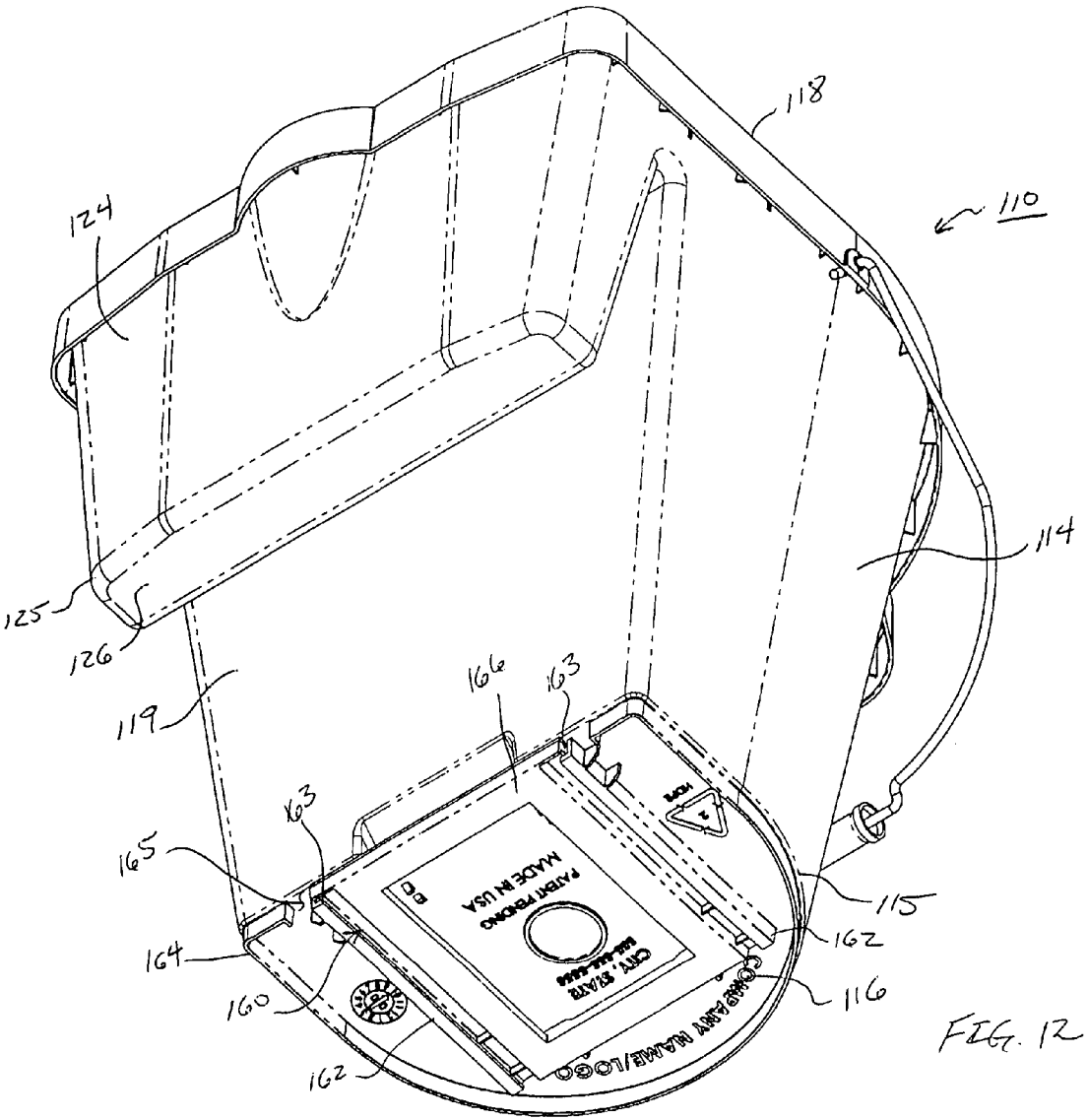
FIG. 12 is a bottom perspective view of another embodiment of a bucket according to the present invention with a base extension stored.
Figure 13:
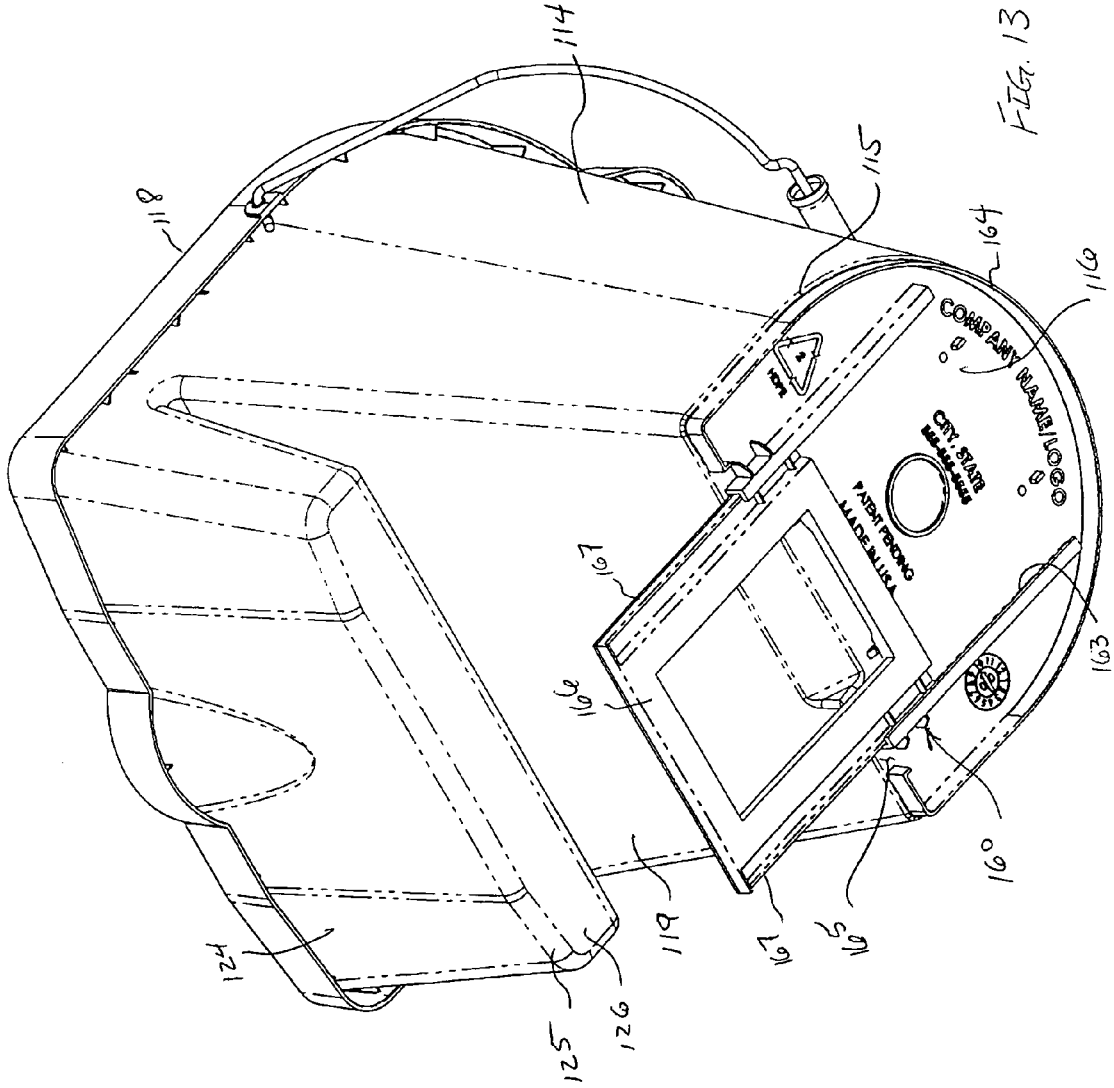
FIG. 13 is a bottom perspective view of the bucket of FIG. 12 with the base extension deployed.
Figure 14:
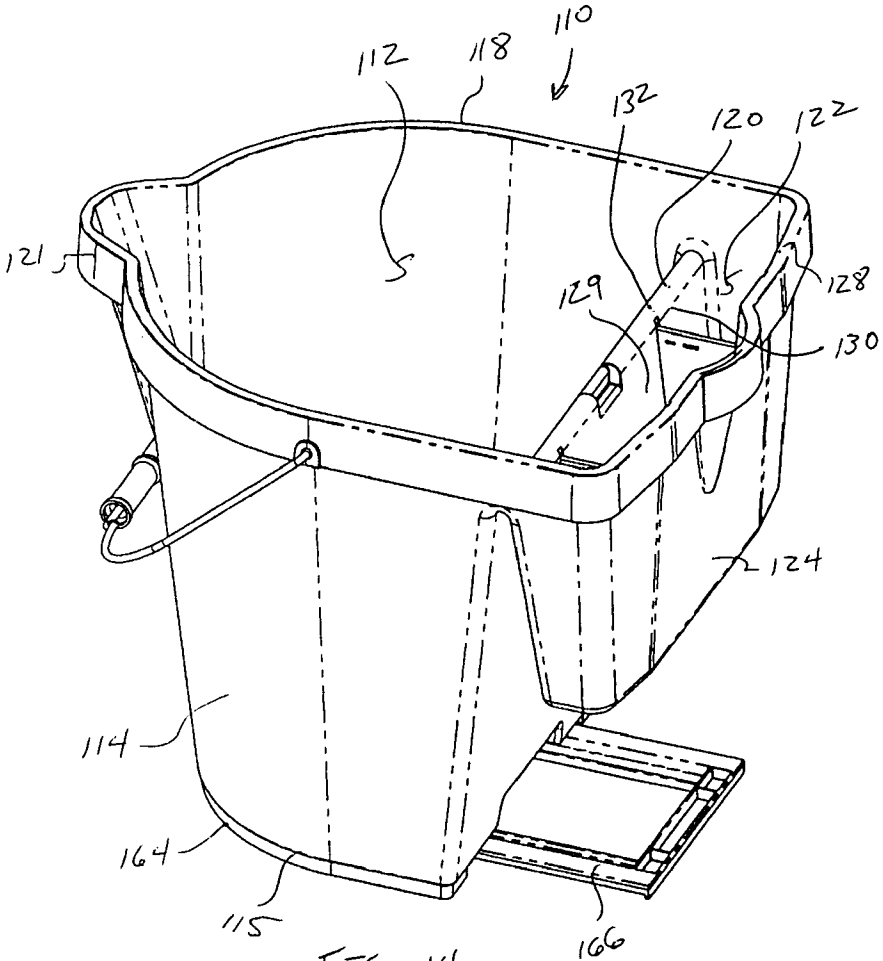
FIG. 14 is a top perspective view of the bucket of FIG. 13 from the rear quarter.
Figure 15:
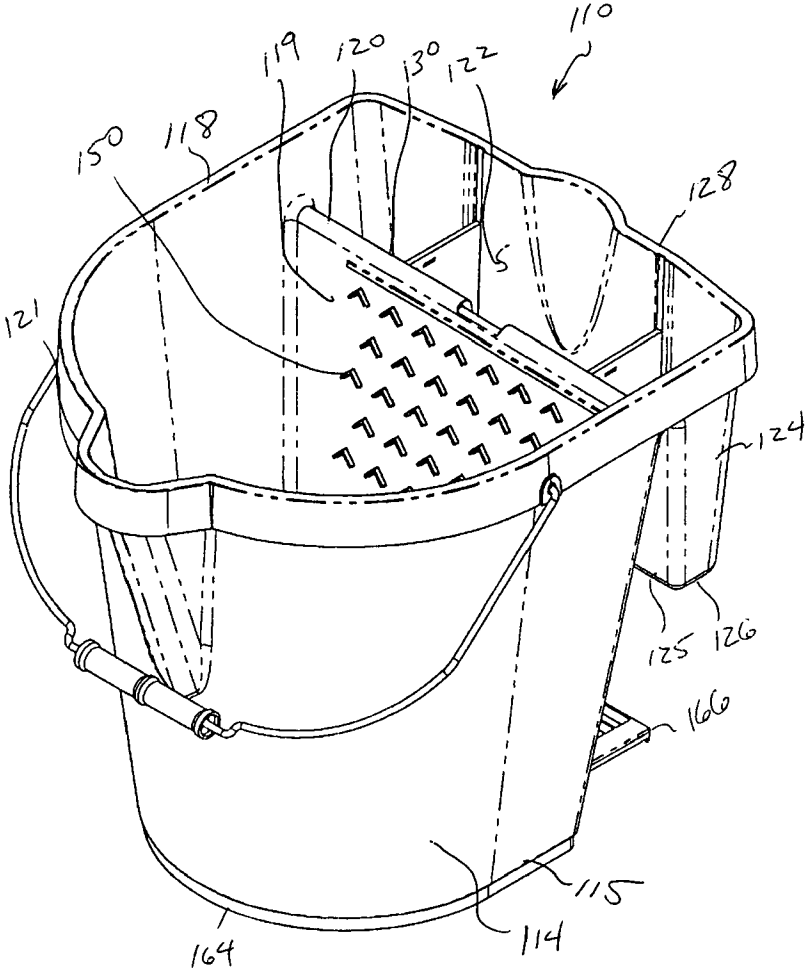
FIG. 15 is a top perspective view of the bucket of FIG. 13 from the front quarter.

An extension member 166 having opposing sides 167 is positioned between rails 162 with opposing sides 167 each received within one of channels 163. Extension member 166 is slidably movable between a stored position as illustrated in FIG. 12, and a deployed position as illustrated in FIGS. 13-15. As can be seen in FIGS, 13-15, in the deployed position, extension member 166 extends outwardly from bottom 116 and sidewall 114 through gap 165 to a position underlying secondary volume 122. Extension member 166 has sufficient rigidity to provide additional stability to bucket 110 when force is applied to flattened portion 119. To prevent overextension or inadvertent storage of extension member 166, tabs can be provided within channels to receive and engage detents carried by extension member when moved to the deployed position.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

The invention claimed is:

1. A bucket comprising:

a first volume defined by a continuous primary sidewall extending from a periphery of a first bottom to a primary rim;

the continuous primary sidewall including a flattened portion extending from the periphery of the first bottom to a subjacent portion of the primary rim;

an inner surface of the flattened portion of the primary sidewall being textured to form a paint roller grid;

a second volume defined by a continuous secondary sidewall extending from a periphery of a second bottom to a secondary rim;

the continuous secondary sidewall including a flattened portion extending from the periphery of the second bottom to a subjacent portion of the secondary rim adjacent the subjacent portion of the primary rim;

an edge coupling the subjacent portion of the secondary rim and the subjacent portion of the primary rim; and an extension member carried by an outer surface of the first bottom and movable between a stored position underlying the first bottom and a deployed position extending outwardly from and parallel to the first bottom, underlying the second volume.

2. A bucket as claimed in claim 1 wherein the primary rim and the secondary rim form a continuous periphery about the subjacent portion of the secondary rim and the subjacent portion of the primary rim.

3. A bucket as claimed in claim 1 wherein the first bottom is spaced from the second bottom and the flattened portion of the primary sidewall diverges from the flattened portion of the secondary sidewall, from the edge to the first bottom and the second bottom, respectively.

4. A bucket as claimed in claim 1 further including a pair of parallel spaced apart rails carried by the outer surface of the first bottom, the extension member slidably engaging the pair of parallel spaced apart rails.

5. A bucket as claimed in claim 4 further including a footing extending perpendicularly from the first bottom at least as far as a depth of the pair of parallel spaced apart rails and extending around the periphery of the first bottom, the footing having a gap therein for passage of the extension member to the deployed position.

6. A bucket as claimed in claim 4 wherein the rails each define an inwardly directed channel extending the length thereof with edges of the extension member slidably received therein.

7. A bucket comprising:

a first volume defined by a continuous primary sidewall extending from a periphery of a first bottom to a primary rim;

the continuous primary sidewall including a flattened portion extending from the periphery of the first bottom to a subjacent portion of the primary rim;

an inner surface of the flattened portion of the primary sidewall being textured to form a paint roller grid;

a second volume defined by a continuous secondary sidewall extending from a periphery of a second bottom to a secondary rim;

the continuous secondary sidewall including a flattened portion extending from the periphery of the second bottom to a subjacent portion of the secondary rim adjacent the subjacent portion of the primary rim;

an edge coupling the subjacent portion of the secondary rim and the subjacent portion of the primary rim;

the primary rim and the secondary rim, absent the subjacent portion of each, form a continuous periphery about the subjacent portion of the secondary rim and the subjacent portion of the primary rim;

a collar extending from the continuous periphery adjacent the primary sidewall and the secondary sidewall a distance defining a stacking height of the bucket;

the edge subjacent the continuous periphery a distance greater that the stacking height; and an extension member carried by an outer surface of the first bottom and movable between a stored position underlying the first bottom and a deployed position extending outwardly from and parallel to the first bottom, underlying the second volume.

8. A bucket as claimed in claim 7 further including a pair of parallel spaced apart rails carried by the outer surface of the first bottom, the extension member slidably engaging the pair of parallel spaced apart rails.

9. A bucket as claimed in claim 8 further including a footing extending perpendicularly from the first bottom at least as far as a depth of the pair of parallel spaced apart rails and extending around the periphery of the first bottom, the footing having a gap therein for passage of the extension member to the deployed position.

10. A bucket as claimed in claim 9 wherein the rails each define an inwardly directed channel extending the length thereof with edges of the extension member slidably received therein.

11. A bucket as claimed in claim 7 further including a plurality of divider bases extending from the second bottom a distance equal to or less than the stacking height of the bucket.

12. A bucket as claimed in claim 7 wherein divider panels removably engage the divider bases, dividing the second volume into a plurality of compartments.

* * * * *